US005195596A

United States Patent [19]

Mount III et al.

[11] Patent Number: 5,195,596

[45] Date of Patent: Mar. 23, 1993

[54] FIREHOSE CARRYING CASE

[76] Inventors: William T. Mount III, 5203 Lynnwood Dr., Camarillo, Calif. 93012; Elwynn J. Brunelle, 18819 Nadal St., Canyon Country, Calif. 91351

[21] Appl. No.: 770,239

[22] Filed: Oct. 3, 1991

[51] Int. Cl.[5] ..... A62C 39/00

[52] U.S. Cl. ..... 169/52; 224/205; 224/236

[58] Field of Search ..... 169/51, 52; 224/202, 224/205, 206, 236, 42.11, 901, 905

[56] References Cited

U.S. PATENT DOCUMENTS

| | | | |
|---|---|---|---|
| 501,821 | 7/1893 | Browne | 224/905 X |
| 747,681 | 12/1903 | Bradbury | 224/205 |
| 1,136,691 | 4/1915 | Mease | 224/905 X |
| 2,266,334 | 12/1941 | Rice | 224/236 X |
| 3,722,823 | 3/1973 | Reich et al. | 224/162 X |
| 3,739,961 | 6/1973 | Soukeras | 224/205 X |
| 3,796,357 | 3/1974 | Johnson | 224/206 |
| 4,126,256 | 11/1978 | McGruder | 224/205 X |
| 4,423,834 | 1/1984 | Rush | 224/236 X |
| 4,600,134 | 7/1986 | Colby | 224/260 |
| 4,685,601 | 8/1987 | Riddling | 224/153 X |
| 4,811,768 | 3/1989 | Williams | 224/206 X |
| 4,858,797 | 8/1989 | Rabska | 224/162 |
| 4,867,359 | 9/1989 | Donovan | 224/202 |
| 4,883,207 | 11/1989 | McArthur | 224/236 X |

*Primary Examiner*—Charles A. Marmor
*Assistant Examiner*—Gary C. Hoge
*Attorney, Agent, or Firm*—Robert M. Sperry

[57] ABSTRACT

An improved firehose storage and transportation device comprising a carrying case having front and rear compartments wherein a firehose is stored in a serpentine manner and formed with a releasably secured flap to give the user the option of discharging the hose as a single unit or of allowing the hose to be paid out gradually.

3 Claims, 1 Drawing Sheet

FIREHOSE CARRYING CASE

BACKGROUND

1. Field of Invention

This invention relates to firehoses and is particularly directed to means, such as a carrying case for storing and transporting a firehose.

2. Prior Art

In the course of fighting fires, firemen are frequently required to transport firehoses from a fire engine to the location where the hose is needed. Unfortunately, firehoses must often be transported a considerable distance from the fire engine to the location of use. Furthermore, the transportation of the firehoses usually must be conducted manually and frequently requires that the fireman carry the firehose a considerable distance into a burning building, which is filled with smoke and flame and which may have collapsing structure blocking the route or endangering the fireman during the delivery of the hose. Thus, the transportation of the firehose is extremely difficult and dangerous. To simply grasp the hose nozzle and proceed to drag the firehose behind the fireman would cause the fireman to drag a rapidly increasing weight as the hose paid out and would risk the hose becomming snagged on corners or debris, which would interfere with movement of the hose, delay transportation of the hose and subject the fireman to the unnecessary risk of returning to unsnag the hose. Thus, it is customary for the fireman to carry the hose and to pay out the hose as he moves about the burning building. However, firehoses are very heavy and bulky and cannot be handled or carried without risk of their becoming uncoiled and, hence, virtually impossible to manipulate or control. Therefore, the transportation of firehoses is an extremely difficult and hazardous, yet necessary and frequent factor in the fireman's daily life.

In order to overcome these problems, there have been numerous proposals for packaging the firehose to provide a safer and more convenient means for storing and transporting the hose. Unfortunately, most of the prior art firehose storage and transportation devices have been only partial solutions and have often created as many problems as they solved. A search in the U.S. Patent Office has revealed the following:

| U.S. Pat. No. | INVENTOR | ISSUED |
|---|---|---|
| 3,722,823 | A. Reich et al | Mar. 27, 1973 |
| 4,858,797 | W. G. Rabska | Aug. 22, 1989 |
| 4,685,601 | C. C. Riddling | Aug. 11, 1987 |
| 4,600,134 | J. S. Colby | Jul. 15, 1986 |

The patent to Reich et al discloses a metal rack for storing and transporting a firehose. Unfortunately, this device adds very considerably to the weight and bulk of the firehose and, hence, adds to the difficulty of manually transporting the firehose. The Rabska device facilitates simultaneous transportation of a plurality of firehoses, but requires removal of a coiled hose, as one unit, and does not permit the hose to be gradually paid out as the fireman moves thought the burning building or through brush, forest or rough terrain. If an attempt were made to gradually pay out the hose from Rabska's device, it would require that the hose rotate within the backpack, in order to uncoil, as the fireman was moving through the burning building, and this would result in friction, against the other hose and the straps of the device, which would greatly increase the difficulty of movement for the fireman. Furthermore, neither of the devices of Reich or Rabska could be used by a fireman using an air bottle for breathing. Paying out hose from the Riddling device would create a rocking motion, as the hose paid out from one side to the other and back, which would make is difficult for the fireman to maintain his balance and, hence, could increase the danger of transporting the firehose. The Colby device would carry one hose in each of its pouches and would, obviously, provide an increasingly unbalanced load, if either of the hoses were gradually paid out from its pouch. Thus, none of the prior hose storage and transportation devices have been entirely satisfactory.

BRIEF SUMMARY AND OBJECTS OF INVENTION

These disadvantages of the prior art are overcome with the present invention and an improved firehose storage and transportation device is provided which is light in weight and which permits compact stowing of the firehose for storage and transportation, yet which can be carried simply and conveniently and which allows the hose to be released as a unit or to be gradually paid out in a balanced manner which will provide a minimum of interference to movement of the fireman.

These advantages of the present invention are preferably attained by providing a carrying case having front and rear compartments wherein a firehose is stirred in a serpentine manner and formed with a releasably secured flap to give the user the option of discharging the hose as a single unit or of allowing the hose to be paid out gradually.

Accordingly, it is an object of the present invention to provide an improved firehose storage and transportation device.

Another object of the present invention is to provide an improved firehose storage and transportation device which is compact and light in weight.

An additional object of the present invention is to provide an improved firehose storage and transportation device which can be simply and conveniently carried by a fireman.

A further object of the present invention is to provide an improve firehose storage and transportation device which permits the firehose to be carried, as a unit, or paid out gradually, at the option of the fireman carrying the hose.

A specific object of the present invention is to provide an improved firehose storage and transportation device comprising a carrying case having front and rear compartments wherein a firehose is stored in a serpentine manner and formed with a releasably secured flap to give the user the option of discharging the hose as a single unit or of allowing the hose to be paid out gradually.

These and other objects and features of the present invention will be apparent from the following detailed description, taken with reference to the figures of the accompanying drawing.

DETAILED DESCRIPTION OF THE INVENTION

Figure 1:
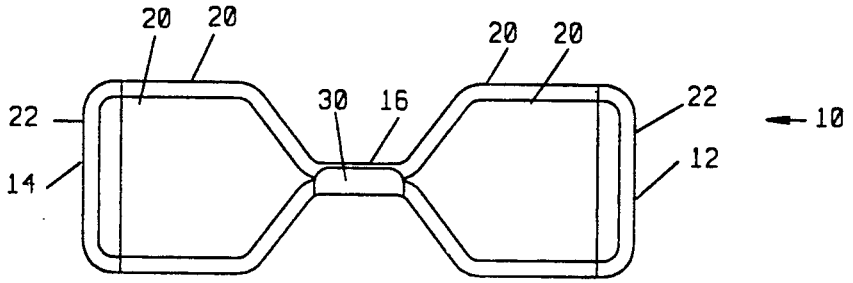
FIG. 1 is a plan view of a firehose storage and transportation device embodying the present invention.
Figure 2:
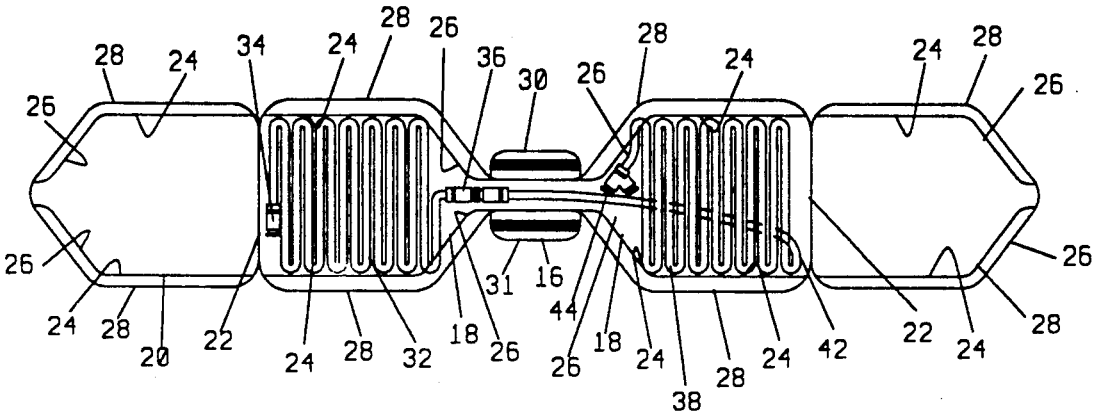
FIG. 2 is a view, similar to that of FIG. 1, showing the firehose storage and transportation device of the present invention with the pouches open to show stowage of a firehose therein.

In that form of the present invention chosen for purposes of illustration in the drawing, FIG. 1 shows a firehose storage and transportation device, indicated generally at 10, having a pair of pouches 12 and 14 joined by a strap 16. As best seen in FIG. 2, each of the pouches 12 and 14 comprises an inner panel 18 and an outer panel 20, which is secured to the inner panel 18 along the lower edge seam 22. The panels 18 and 20 are preferably generally rectangular, having parallel sides 24 and having the upper edges 26 inclining upward to join the strap 16. Flaps 28 extending along the sides 24 and upper edges 26 of each of the panels 18 and 20 and carry releasable fastening means, such as strips of hook-and-loop material, to permit releasably attaching the flaps 28 of the inner panels 18 to the flaps 28 of the outer panels 20 to form the pouches 12 and 14, as seen in FIG. 1. Similarly, the strap 16 is provided with flaps 30 extending along each side of the strap 16 and carrying releasable fastening means, such as strips of hook-and-loop material, to permit the flaps 30 to be secured together to retain a hose extending parallel to the strap 16.

In use, the firehose storage and transportation device 10 is placed on a floor or table and is opened up, as seen in FIG. 2. A firehose 32 is then loaded into the device 10 in a serpentine manner, starting by placing one end 34 of the hose 32 on the inner panel 18 of the rear pouch 14 adjacent the lower edge seam 22 and extending across the inner panel 18, from side to side, in a fan-fold manner until the opposite end 36 of the hose 32 has reached the top of the inner panel 18 adjacent the strap 16. At this point, the outer panel 20 of the rear pouch 14 is brought up over the hose 32 and the flaps 28 of the outer panel 20 are releasably secured to the flaps 28 of the inner panel 18 to form the rear pouch 14 and to releasably retain the hose 32 within the rear pouch 14. A second hose 38 has one end 40 connected to end 36 of the first firehose 32 and extends across the strap 16 and diagonally downward across the inner panel 18 of the front pouch 12 to a point adjacent the lower seam 22, as seen at 42 in FIG. 2. Thereafter, the hose 38 is carried from across the lower edge 22 of inner panel 18 of the front pouch 12 and continues from side to side across the inner panel 18 in a fan-fold manner until the free end 44 of the hose 38 has reached the top of the inner panel 18 of the front pouch 12. After this, the outer panel 20 of the front pouch 12 is brought up and over the hose 38 and flaps 28 of the outer panel 20 are releasably secured to the flaps 28 of the inner panel 18 to form the front pouch 12 and to releasably retain the hose 38 within the front pouch 12. Finally, flaps 30 of the strap 16 may be releasably secured together to releasably retain that portion of the hose 38 which extends across the strap 16.

Figure 3:
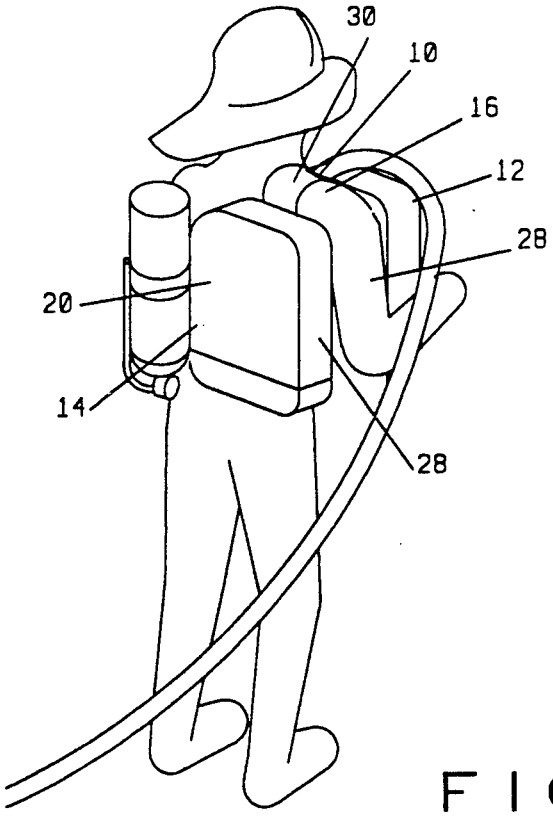
FIG. 3 is a diagrammatic representation showing a fireman carrying the firehose storage and transportation device of FIG. 1.

For storage, the front pouch 12 may be placed on top of the rear pouch 14 and the device 10, with the hoses 32 and 38 contained therein, may be stored on the floor or on a table or shelf. Alternatively, the device 10 may be stored by hanging the strap 16 over a peg or the like. When the hoses 32 and 38 are needed, a fireman can place the strap 16 over his shoulder, as seen in FIG. 3, with the front pouch 12 extending across his chest and with the rear pouch 14 extending across his back. As seen in FIG. 3, the device 10 can easily be carried by a fireman, even when the fireman is wearing an air bottle. If desired, the fireman can carry the device 10 to a desired location, unopened, and can unfasten the flaps 28 to release the entire length of the hoses 32 and 38. Alternatively, the fireman can connect free end 44 of hose 38 to a hydrant or the like and can partially open the flaps 28 of panels 18 and 20 of the front pouch 12. Thereafter, the hose 38 will pay out gradually and smoothly as the fireman moves toward the fire. When the entire hose 38 has been paid out, the fireman can release flaps 30 on the strap 16 and can partially open the flaps 28 on the panels 18 and 20 of the rear pouch 14 to allow hose 32 to gradually pay out as the fireman continues to move through the building. Because of the serpentine loading of the hoses 32 and 38 within pouches 12 and 14 of the device 10, the hoses 32 and 38 can be paid out smoothly and evenly in a manner which will not interfere with the movements of the fireman and without causing uneven loading or movement which might tend to unbalance the fireman.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A firehose storage and transportation device comprising:

a pair of pouches joined by a strap, each of said pouches having a front panel and a rear panel secured together along a lower edge and having flaps extending along the other edges of said panels with releasable fastening means carried by said flaps to permit said flaps to be releasably secured together to enable said panels to form said pouches, at least one firehose loaded in said device in a serpentine manner with one end of said firehose located adjacent the lower edge of one of said pouches and extending across said pouch from side to side until the hose reaches the top of said one of said pouches adjacent said strap and at least a portion of said firehose extends across said strap and diagonally downward to a point adjacent the lower edge of the other of said pouches and continues from side to side across the other of said pouches until the hose reaches the top of said other of said pouches adjacent said strap and the flaps extending along said strap serve to releasably retain said portion of said firehose.

2. A firehose storage and transportation device comprising:

a pair of pouches joined by a strap, each of said pouches having a front panel and a rear panel secured together along a lower edge and having flaps extending along the other edges of said panels with releasable fastening means carried by said flaps to permit said flaps to be releasably secured together to enable said panels to form said pouches, flaps extending along each side of said strap and carrying releasable fastening means to permit said flaps to be releasably secured together, at least one firehose loaded in said device in a serpentine manner with a portion of said firehose extending across said strap and diagonally downward to a point adjacent the lower edge of the other of said pouches and continues from side to side across the other of said pouches until the hose reaches the top of said other of said pouches adjacent said strap and the flaps extending along said strap serve to releasably retain said portion of said firehose.

3. The device of claim 2 wherein:

said firehose has one end located adjacent the lower edge of one of said pouches and extends across said pouch from side to side until the hose reaches that top of said one of said pouches adjacent said strap.

* * * * *